United States Patent [19]

Katsufrakis

[11] 4,145,827

[45] Mar. 27, 1979

[54] ASSEMBLY FOR THE DISPLAY OF PICTURES

[76] Inventor: Peter G. Katsufrakis, 3428 Dragoo Park Dr., Modesto, Calif. 95350

[21] Appl. No.: 734,030

[22] Filed: Oct. 20, 1976

[51] Int. Cl.[2] ..... G09F 1/12

[52] U.S. Cl. ..... 40/152

[58] Field of Search ..... 40/152, 152.1, 156; D6/234

[56] References Cited

U.S. PATENT DOCUMENTS

| | | | |
|---|---|---|---|
| D. 47,835 | 9/1915 | Szabo | D6/234 |
| 200,713 | 2/1878 | Griffin | 40/152 |
| 224,973 | 2/1880 | Wallis | 40/152 |
| 975,094 | 11/1910 | Williams | 40/152 |
| 2,647,834 | 8/1953 | Rabkin et al. | 40/152 X |
| 3,105,316 | 10/1963 | Ison | 40/155 |
| 3,416,765 | 12/1968 | Ebner | 40/152.1 |
| 3,471,959 | 10/1969 | Seger | 40/152 |
| 3,771,244 | 11/1973 | Ebner | 40/152 |
| 3,782,015 | 1/1974 | Esry | 40/152 |
| 4,033,060 | 7/1977 | Lawrence | 40/154 |

*Primary Examiner*—Russell R. Kinsey
*Assistant Examiner*—Wenceslao J. Contreras
*Attorney, Agent, or Firm*—Phillips, Moore, Weissenberger, Lempio & Majestic

[57] ABSTRACT

An assembly for the display of pictures is formed of a plurality of elongated members rabbeted at predetermined locations for interconnection, one with the other, to form varying dimensioned rectangular shaped openings. Backing members formed to fit in the openings are included for mounting individual pictures thereupon. Mounting means fixable to the elongated members by conventional adhesive provide a convenient surface for wall mounting.

7 Claims, 9 Drawing Figures

ASSEMBLY FOR THE DISPLAY OF PICTURES

BACKGROUND OF THE INVENTION

This invention relates to the display of small photographs such as snapshots and the like. In particular it relates to an assembly providing one or more openings for the display of pictures. The invention is described in a kit form for assembly by an amateur photographer.

The product of a small handheld camera in the form of a snapshot, or the like, is a familiar item. Artful display of these snapshots is an expensive proposition in most cases. The expense is in the purchase of a rigid frame usually metallic with a glass protective member to cover the snapshot or snapshots. Although such frames are useful and serve the purpose of display, the expense militates against purchase. Quite frequently the photographer wishes to display two or more pictures of a series for a brief period of time while retaining the ability to re-utilize the display member for a new series of photographs.

It has been found that snapshots of the type envisioned for use in this invention generally have one common dimension with a variance in the second dimension. The one dimension has been found to be approximately 3½" (88.9 mm). The second dimension varies from 2½" (63.5 mm) to 5" (127 mm) with intermediate dimensions of 3½" and 4½" (114.3 mm). Larger sizes are available but generally only in the event of an enlargement involving a special order at the photoprocessing firm. Other snapshot sizes are available but are not found in large numbers.

SUMMARY OF THE INVENTION

Accordingly, this invention provides in kit form the necessary elements to assemble frames having multiple openings of various dimensions. This adaptability precludes the purchaser from having to remember dimensions of snapshots at the time of purchase of this frame assembly.

It is an object of this invention to provide a low cost frame assembly for snapshots and the like.

It is further an object of this invention to provide a low cost frame assembly which is easily assembled by the user.

It is still another object of this invention to provide a low cost frame assembly which may be disassembled and reassembled in different shapes to form different openings.

Broadly stated, the invention is a kit adapted for assembly in a plurality of configurations to display photographs or the like. The kit is comprised of a plurality of elongated members of predetermined length, each elongated member defining rabbets proximate the ends thereof for interconnection of one member with another member. A predetermined number of the plurality of elongated members are interconnectable to form openings of predetermined sizes. Backing means are positionable in the openings with each backing means defining a surface upon which a photograph may be affixed. Mounting means for facilitating wall mounting are also included.

The aforesaid objects and others will become apparent from a study of the following description and the accompanying drawings.

DETAILED DESCRIPTION OF THE PREFERRED EMBODIMENT

In the following description, like numerals refer to like items in the various embodiments. In an alternate embodiment if a similar item is utilized, the numeral will be indicated with a prime.

Figure 1:
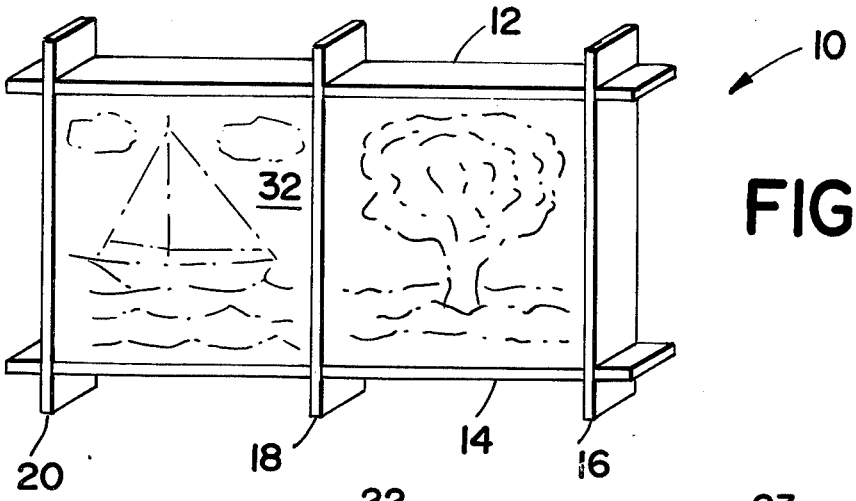
FIG. 1 shows in perspective one configuration of the multiple element picture frame which is the subject of this invention.

A picture frame 10 assembled in accord with this invention is illustrated in FIG. 1. Picture frame 10 in a simple form as illustrated in FIG. 1 is comprised of first and second horizontal elongated members 12 and 14 forming respectively the top and the bottom members of a two opening picture frame. In this embodiment, three elongated vertical members 16, 18, and 20 are required. Each elongated member is preferably rectangular in cross section. It should be understood that reference to vertical and horizontal refers only to the orientation of the picture frame as illustrated in FIG. 1. Similarly the terminology top and bottom refers to the orientation in FIG. 1. The picture frame 10 illustrated in FIG. 1 may be rotated 90° so that the openings to be described are oriented one atop the other, rather than in the side-by-side orientation as illustrated in FIG. 1.

Figure 2:
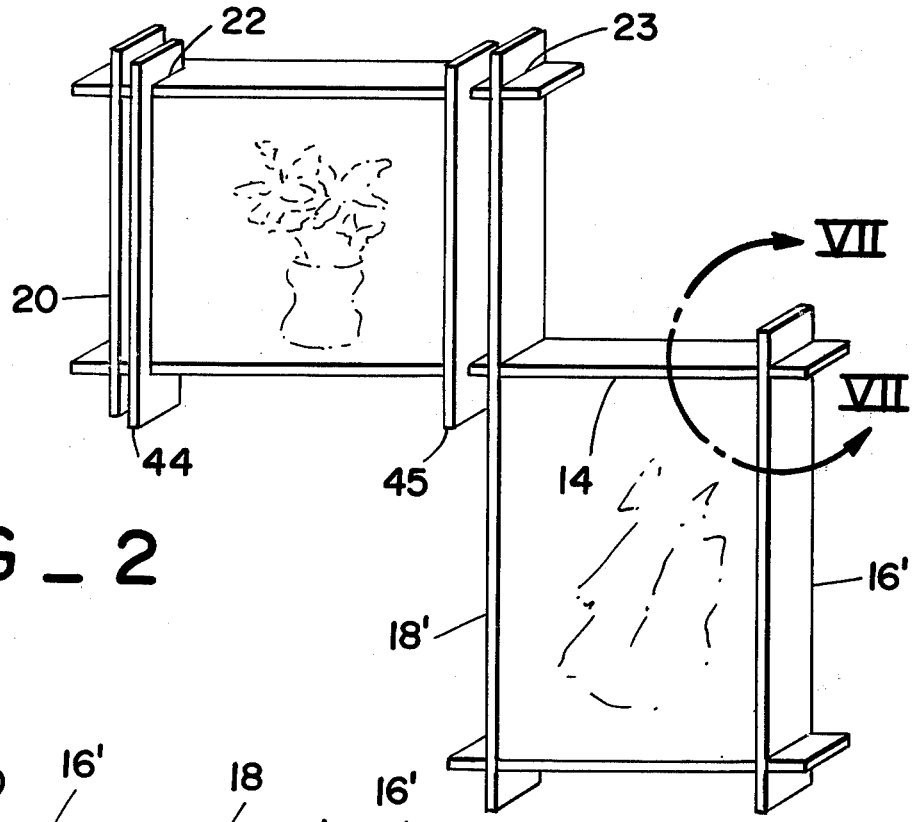
FIG. 2 shows a second configuration available from the same kit.
Figure 3:
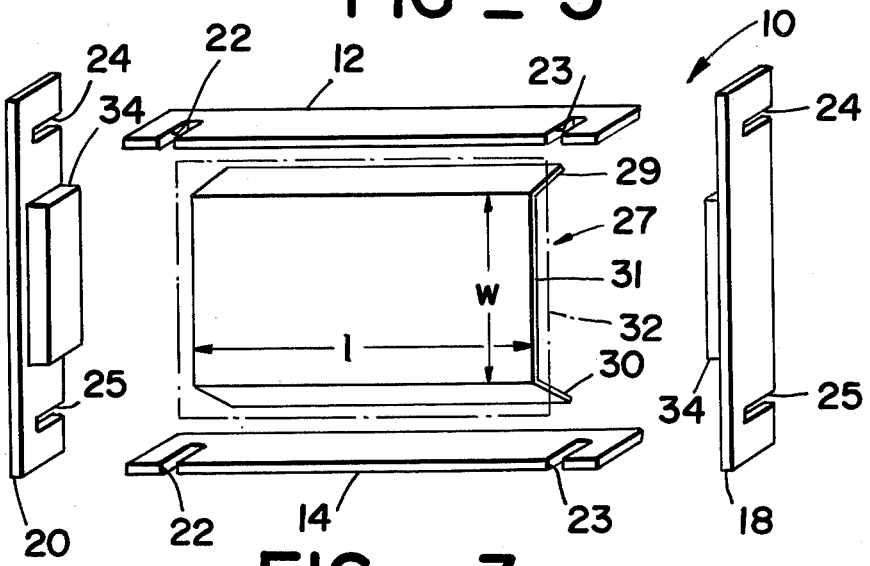
FIG. 3 shows an exploded view of a portion of the assembly shown in FIG. 1.

Referring now to FIG. 3, a single opening of frame 10 as shown in FIG. 1 with a slightly different horizontal/-vertical relationship is shown in exploded form. The top member 12 has formed proximate one end a slot-like groove hereinafter referred to as a rabbet 22 in the manner well-known in the art. Rabbet 22 has a width dimension corresponding to the width of vertical member 20. Horizontal member 14 which forms the bottom of picture frame 10 has a similar rabbet 22 proximate the end thereof. A second rabbet 23 is formed at the other end of horizontal member 12, and similarly a second rabbet 23 is formed at other end of horizontal member 14. Vertical member 20 which forms the left hand end of the frame 10 illustrated in FIG. 1 has similar rabbets, 24 and 25 at the top and bottom respectively, formed to mate with rabbets 22 in the top member and the bottom member to form half lap joints. Vertical member 18 is formed in the same manner as vertical member 20 with similar rabbets 24, 25 positioned proximate the ends thereof to mate with rabbets 23 in top and bottom members 12 and 14 respectively. The distance between rabbets 24 and 25 and rabbets 22 and 23 is predetermined based on the size of the photograph to be mounted in the frame. Specifically, one of these dimensions will generally be 3½" (88.9 mm) and in the embodiment depicted in FIG. 1, the top member 12 and the bottom member 14 are formed with the rabbets 22 and 23 and the rabbets 24 and 25 spaced at an equal distance such as 3½" (88.9 mm). In the embodiments shown in FIG. 2 or 3, the corresponding rabbets 22 and 23 would be at a greater distance such as 4½" (114.3 mm) or 5" (127.0 mm). It is to be understood that these dimensions are for guidance only and are used here to illustrate the varying dimensions that are available. By adding two rabbeted vertical members 44 and 45 in the manner shown in FIG. 2, the 5" (127.0 mm) opening can be reduced to a lesser dimension to accommodate smaller snapshots.

A backing member 27 formed of sheet material such as cardboard, or the like, is generally rectangular in shape and is utilized for mounting the picture. The backing member 27 is formed in three portions. An upper hinge portion 29, a lower hinge portion 30, and a center portion 31. Center portion 31 forms a mounting surface for a photograph 32 shown in phantom in FIG. 3. The representation of photograph 32 shown in FIG. 1 is for illustration purposes only to show a mounted picture in the frame. Center portion 31 has a length dimension L and a width dimension W as illustrated in FIG. 3. In view of the consistency of the 3½" (88.9 mm) dimension of snapshots for which this frame is designed, dimension W is purposely formed slightly less than 3½" with the width of the hinge portions 29 and 30 being formed slightly more than the width of the horizontal frame members 12 and 14. Length L is variable and corresponds generally to the dimension between rabbets 22 and 23.

Figure 9:
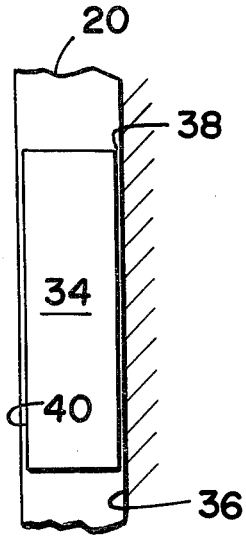
FIG. 9 illustrates the mounting means in relation to a wall.

Wall mounting pads 34, in the form of a rectangular parallelepiped, are fixable to the vertical members 18 and 20 by conventional means such as a two-sided adhesive tape. Referring to FIG. 9, the wall mounting pad 34 is shown in an end view with the wall 36 shown in section. The wall mounting pad is positioned on vertical member 20 such that conventional adhesive means may be utilized to fix the entire frame assembly to wall 36. Such conventional mounting methods would also include pressure sensitive two-sided tape 38 disposed between wall mounting 34 on wall 36. Wall mounting pad 34 can be made of a dimension slightly less than the thickness of the vertical member 18 or 20 so that backing member 27 engages wall mounting pad 34 when in the assembled state. Further, wall mounting pad 34 may carry on its front surface 40 additional adhesive type material to assist in retaining backing member 27 in the proper relationship in the frame members.

Assembly of the frame, such as is illustrated in FIG. 1 or 2 and which is envisioned as being done by the ultimate user, involves selection of the appropriate horizontal members 12 and 14 from plurality of such members supplied the ultimate user in kit form to fit the particular picture to be framed. Vertical members 16, 18, and 20 are also selected. Wall mounting pads 34 are affixed to at least members 16 and 20 midway between rabbets 24 and 25 and flush with the back side thereof. Additional wall mounting pads 34 may be affixed to both sides of vertical member 18 if it is desired to provide a more stable mounting for backing member 27 as described above. Members 16, 18, and 20 are then assembled with horizontal members 12 and 14 in the manner shown in FIG. 6 at the rabbets to form half lapped joints. A photograph or snapshot 32, as the case may be, may then be fixed to backing member 27 by appropriate adhesive means such as a double-surfaced tape.

A single opening, for example 3½" × 5" (88.9 mm × 127 mm), can be adapted for smaller pictures in one of several ways. One way is shown in the upper opening of FIG. 2 wherein additional vertical members 44 and 45 which are similar to vertical member 20 have been associated with the frame to reduce the opening from 3½" × 5" (88.9 mm × 127 mm) to 3½" × 3½" (88.9 mm × 88.9 mm) for example. A second way (not shown) of reducing the opening is to affix to the backing member a patterned material of predetermined size to fill the unused space.

It is envisioned that the kit will be provided with an assortment of members to cover the dimensions indicated in the background of the invention in at least sufficient quantity to assemble frames in the configuration shown in FIG. 1 and FIG. 2. Other assortments may be provided to cover at least the other configurations shown.

Figure 8:
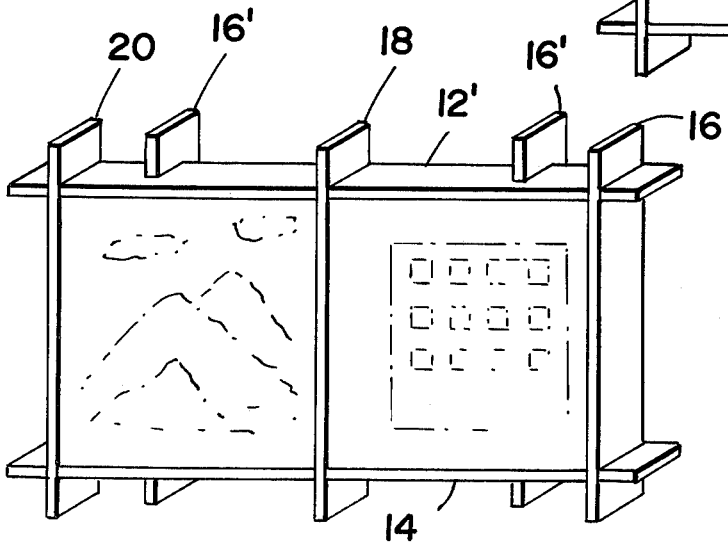
FIG. 8 shows an alternate embodiment of the frame shown in FIG. 1.
Figure 6:
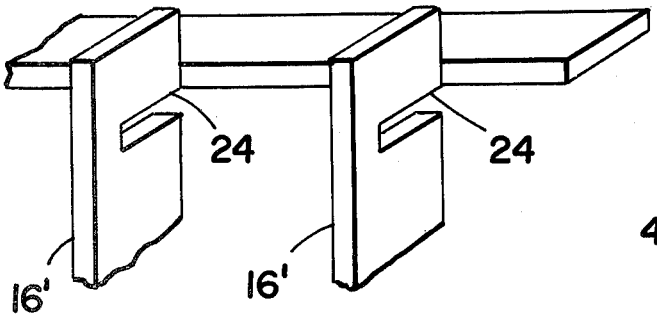
FIG. 6 shows an alternate embodiment of the rabbeting features of this invention.

An alternate embodiment is shown in FIG. 8 which adds additional vertical elements in the manner of vertical element 16' at positions on the horizontal members 12' and 14' not coincident with the rabbets formed therein. This particular configuration is adaptable for use as a frame for positioning on a table or a mantle piece. Particular details are shown in FIG. 6.

Figure 5:
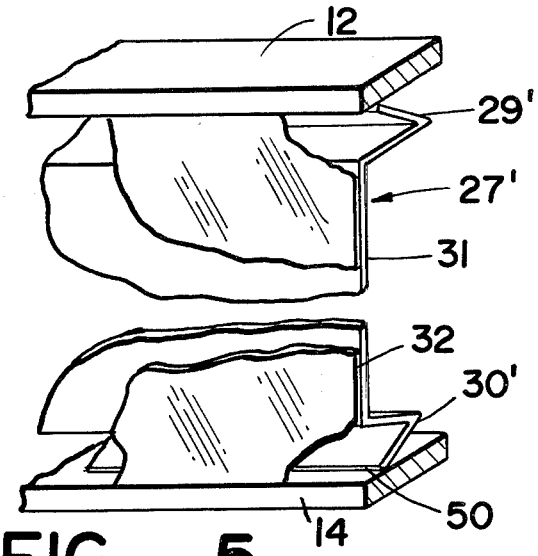
FIG. 5 shows an alternate embodiment of the backing member.

Shown in FIG. 5 is another embodiment of backing member 27'. In this embodiment, the hinge portion 29' is folded back on itself to form first and second subportions. This embodiment is easier to assemble in that insertion of the mounted picture from the front of the frame is not hindered by the edge 50 of the hinge portion 29'.

Figure 7:
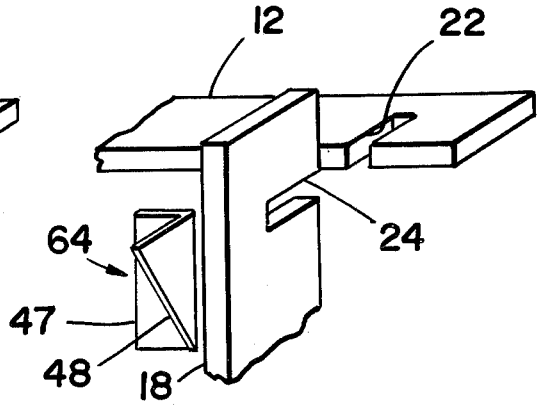
FIG. 7 shows in detail an exploded view of the corner joint VII—VII in FIG. 2, along with an alternate embodiment of the wall mounting pad.

An alternate mounting pad 64 is shown in FIG. 7. Mounting pad 64 comprises an angle bracket having a rectangular portion 47 and unitarily formed therewith generally at a right angle a triangular portion 48. Two such mounting pads 64 are fixable to parallel oriented elongated members to provide a surface for affixing the assembly to a wall surface (not shown) by means well-known in the art.

Figure 4:
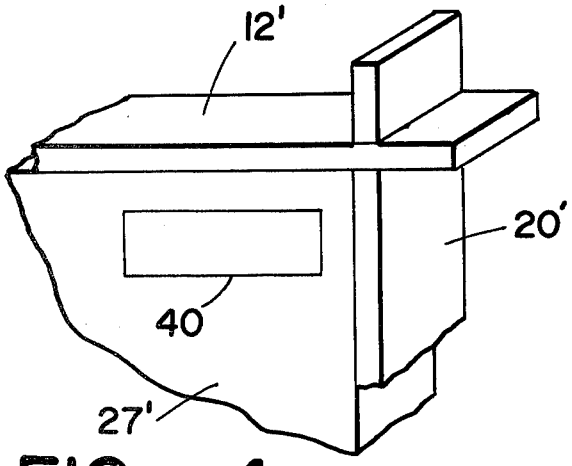
FIG. 4 illustrates from the back an alternate embodiment of this invention.

An alternate backing member 27', which also suffices as a wall mounting member, is shown in FIG. 4. The backing member 27' may be made of foam plastic material also utilized for the wall mounting pad in the primary embodiment. The doublebacked adhesive tape 40 may be positioned at appropriate spots on backing member 27' on one side to mount the frame to the wall and on the other opposite side to receive the photograph 32.

Although this invention has been described with particularity with regard to certain embodiments, other modifications including other wall mounting features are to be considered within the purview of the specification.

I claim:

1. An assembly for the display of a plurality of photographs comprising:

a plurality of elongated members defining rabbets proximate each end thereof, at least two of said elongated members defining an additional rabbet generally at the mid-point thereof, said rabbets for half lapped interconnection of said elongated members to form at least two adjacent rectangular openings:

at least two backing members formed to be received in said openings, each backing member defining a surface for mounting a picture thereupon, each backing member rectangular shaped and formed of stiff sheet material and having predefined opposed edge portions hingeable backwardly and a center mounting portion;

means for mounting said assembly.

2. The assembly set forth in claim 1 wherein one of the surface dimensions of the rectangular backing member is substantially equal to a dimension of one of the openings formed by the plurality of elongated members, while the second other dimension of the rectangular backing member is greater than the corresponding second dimension of the one opening.

3. The assembly set forth in claim 2 wherein the center mounting portion has the same one dimension as the one dimension of the rectangular backing member and has a second dimension less than the second other dimension of the opening formed by the plurality of elongated members;

4. The assembly set forth in claim 3 wherein the means for mounting the assembly comprises at least two rectangular parallelepipeds fixable to parallel-oriented elongated members and having pressure sensitive adhesive surfaces for affixing the assembly to a wall surface.

5. The assembly set forth in claim 4 further comprising additional means for associating the backing member with the plurality of elongated members said additional means comprising double-surfaced adhesive tape positioned on front surfaces of each of the parallelepipeds.

6. The assembly set forth in claim 3 wherein the means for mounting the assembly comprises two angle brackets each having a rectangular portion and a triangular portion unitarily formed with and generally at right angles to the rectangular portion, said brackets fixable to parallel-oriented elongated members for affixing the assembly to a wall surface.

7. The assembly set forth in claim 1 wherein the two elongated members defining additional rabbets at the midpoint thereof form the top and bottom horizontal members of an assembly for the display of two photographs in side-by-side relation, the remaining plurality of elongated members comprising three similar elongated members interconnecting in parallel relation with the rabbets of the two elongated members to form the vertical members of a two opening picture frame;

the means for mounting the assembly comprising two additional elongated members each rabbeted at each end, each additional elongated member disposed between the top and bottom horizontal members with the end rabbets in overlapping relation therewith.

* * * * *